United States Patent [19]

Pennock

[11] 4,137,975

[45] Feb. 6, 1979

[54] DRILLING METHOD

[75] Inventor: Michael D. Pennock, Pinner, England

[73] Assignee: The British Petroleum Company Limited, Sunbury-on-Thames, England

[21] Appl. No.: 795,226

[22] Filed: May 9, 1977

[30] Foreign Application Priority Data

May 13, 1976 [GB] United Kingdom ..... 19690/76

[51] Int. Cl.[2] ..... E21B 3/12

[52] U.S. Cl. ..... 175/65; 175/106; 175/107

[58] Field of Search ..... 175/65, 106, 107, 101, 175/213, 214, 324

[56] References Cited

U.S. PATENT DOCUMENTS

| | | | |
|---|---|---|---|
| 1,412,430 | 4/1922 | Verneuil | 175/106 |
| 2,815,934 | 12/1957 | Collins | 175/324 X |
| 2,898,087 | 8/1959 | Clark | 175/107 X |
| 2,984,309 | 5/1961 | Welchon | 175/107 X |
| 3,077,358 | 2/1963 | Costa | 175/324 X |
| 3,112,801 | 12/1963 | Clark et al. | 175/107 |
| 3,695,370 | 10/1972 | Jones | 175/106 |
| 3,732,143 | 5/1973 | Joosse | 175/101 X |
| 3,823,788 | 7/1974 | Garrison et al. | 175/107 X |
| 3,999,901 | 12/1976 | Tschirky | 175/107 X |

FOREIGN PATENT DOCUMENTS

| | | | |
|---|---|---|---|
| 39861 | 7/1957 | Poland | 175/69 |

*Primary Examiner*—Stephen J. Novosad

*Attorney, Agent, or Firm*—Morgan, Finnegan, Pine, Foley & Lee

[57] ABSTRACT

A pump is installed in a drill string above the bit and both the bit and pump are connected to the outputs of a differential gearing located therebetween. The circulation of drilling fluids is the reverse from the conventional and by operating a valve in the drill string the torque applied to the bit and pump can be controlled. Useful for drilling weak formations.

3 Claims, 2 Drawing Figures

DRILLING METHOD

Figure 1:
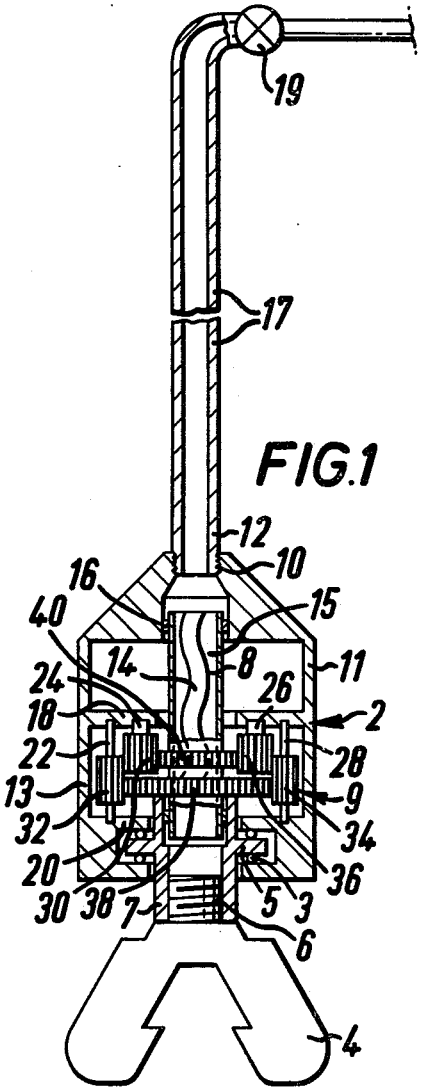

This invention relates to a method and an apparatus for drilling wells, particularly wells at locations submerged underwater.

It is conventional practice in drilling to pump drilling fluid down the interior of the drill string to the drill bit at the bottom of the hole where the drilling fluid mixes with the drill cuttings and the mixture thereby produced flows back to the surface through the annulus between the drill string and casing. The mixture of cuttings and drilling fluid in the annulus can, depending on the length of the annulus, cause a large hydrostatic pressure to be exerted on the formation at the bottom of the hole, and sometimes this hydrostatic pressure can be such that there is a risk of the mixture and/or drilling fluid escaping into the formation.

It is an object of the present invention to reduce this risk.

Thus according to the present invention a method of drilling a hole in a formation comprises employing a drill bit connected to a drill string and rotating the drill bit by means of the drill string to drill the hole and form an annulus between the drill string and the wall of the hole and wherein a drilling fluid is circulated down the annulus and up through the drill string herein referred to as reverse circulation and wherein there is located in the drill string above the drill bit a pump for upwardly moving the drilling fluid to reduce the hydrostatic pressure exerted by the drilling fluid on the formation being drilled.

The pump can conveniently be connected to the bit directly. Above the pump can be a conventional drill string comprising e.g. drill collars and drill pipe. The pump can conveniently be interposed between the drill collars and bit. Alternatively the pump can be located elsewhere in the drill string.

Preferably the pump is a mechanical pump and the drill bit and pump are operatively connected to a differential gearing located therebetween, the differential gearing being driven by the rotation of the drill string, and the method comprises controllably varying the flow of drilling fluid flowing upwardly in the drill string and thereby controlling the torque applied to the pump and bit.

The method of the present invention can be employed for commencing to drill a hole, herein referred to as spudding in, at an offshore location by contacting the formation with the drill bit and rotating the drill string to drive the pump and then reducing the flow of drilling fluid flowing upwardly in the drill string to increase the torque applied to the drill bit.

According to another aspect of the present invention an apparatus for use in reverse circulation drilling to reduce the hydrostatic pressure exerted on the formation being drilled by the drilling fluid comprises:

(a) a drill bit;
(b) a drill string connected to the drill bit;
(c) a pump connected to the drill string above the drill bit;
(d) a differential gearing located between the pump and drill bit and operatively connected thereto, and
(e) a controllable valve arranged to controllably vary the flow of fluid in the drill string the arrangement being such that by controlling the flow of fluids in the drill string the torque applied to the bit and pump can be controlled.

The pump is preferably a positive displacement pump and can be a turbine type of motor, for example as used in turbo drilling, that is a motor which is driveable by fluid pressure supplied from the surface and which can be used in reverse so that by rotating the motor mechanically the latter can be used to pump fluid to the surface. A preferred such motor is one sold under the name of Georotor.

Preferably the valve is located so that when the apparatus is used at an offshore location the valve is above the water surface whereby the torque applied to the pump and bit can be controlled by an operator above the water surface.

The invention is illustrated by the drawings in which

Figure 2:
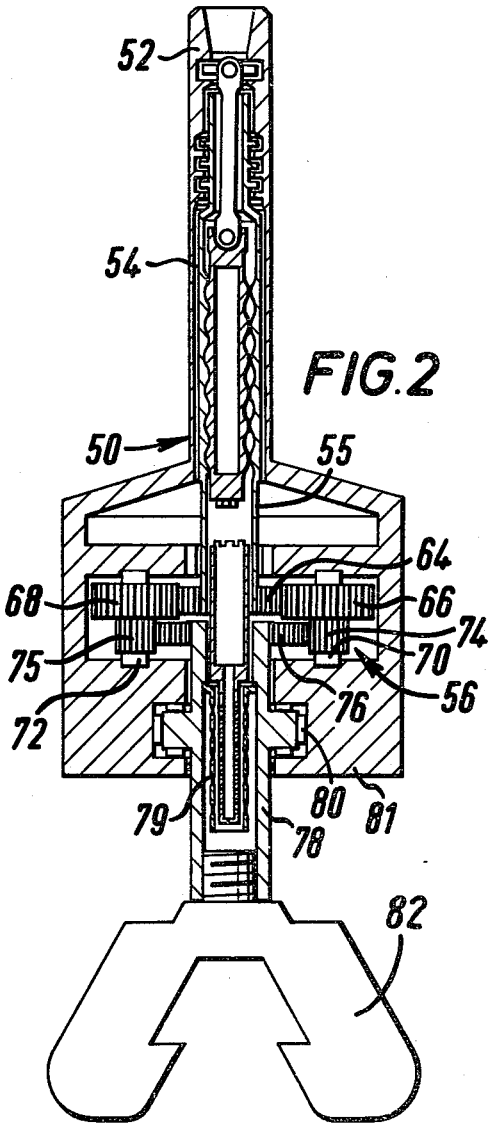

FIG. 1 is a part vertical section of a drilling apparatus including the drill bit and part schematic and FIG. 2 is a vertical section of an alternative embodiment of the invention.

The apparatus indicated generally by reference numeral 2 has a drill bit 4 (of the conventional rock bit type) connected by means of screw thread 6 to an internally screw threaded tubular member 7 which is connected by a differential gearing indicated generally by reference numeral 9 to a positive displacement slurry pump 8 sold under the Trade Name of MONO, which is, in turn connected at its upper end by means of screw thread 10 to drill collars 12 of an otherwise conventional drill string 17. At the upper end of the drill string 17 is a throttling valve 19 and a conventional surface drilling system (not shown). The pump 8 has a housing 11 within which is a stator 15 and rotor 14, there being a seal 16 between the stator 15 and inside housing 11. Built onto the housing 11 is a lower portion 13 having flanges 18 and 20 which carry axles 22, 24, 26 and 28 of toothed wheels 30, 32, 34 and 36. Gear 30 is enmeshed with gear 32 and gear 34 is enmeshed with gear 36. Enmeshed with wheels 32 and 34 is toothed wheel 38 and enmeshed with wheels 30 and 36 is toothed wheel 40 which is connected to and drives the rotor 14. The toothed wheels together make up the differential gearing 9 which is a spur gear epicyclic differential.

The tubular member 7 has a flange 5 supported at bearing 3.

In use the drill string 17 is rotated in a conventional manner at for example 40 and 250 revolutions per minute and drives the bit 4 and the pump 8. The flow of drilling fluids however is the reverse of what is conventional i.e. the drilling fluid flows down the annulus between the casing and drill string and the mixture of drilling fluid and cuttings flows upwardly through the drill string. With the bit 4 squatting on the bottom of the hole and the throttling valve 19 open the pump 8 will run at the speed of the drill string 14 multiplied by a factor proportional to $T_1/T_2$ where $T_1$ and $T_2$ are the number of teeth on wheels 40 and 38 respectively. By throttling back at the surface by means of valve 19 against the pump 8 differential 9 will develop a torque which is applied to the bit 4 which commences to rotate and drilling fluid and cuttings are pumped to the surface.

The bit speed and the pump are thereby controllable at the surface by means of valve 19 and known to an operator.

This embodiment of the invention has the advantages of:

(i) having application where the formation is too weak to support the hydrostatic pressure due to the height of the drilling platform above the water level and thereby preventing loss of drilling fluid and cuttings into the formation at the bottom of the hole;

(ii) having application for drilling out the inside of drilled or driven conductors;

(iii) having application where blind drilling would be detrimental to the platform foundation e.g. detritus deposited within a gravity structure.

With reference to FIG. 2 the apparatus indicated generally by reference numeral 50 comprises a conventional drill string only the lowermost portion 52 of which is shown connected to a reversible motor 54 of the type used in turbo drilling sold under the Trade Name of Georotor. Sleeve 55 of the motor 54 has a toothed wheel 64 mounted thereon which engages toothed wheels 66 and 68 of a differential gearing indicated generally by reference numeral 56.

A drill bit 82 is also connected to the differential gearing 56.

In use the drill string can be held stationary at the surface and the motor powered by sea water pumped down the inside of the drill string. The sleeve 55 of the georotor 54 is caused to rotate by sea water and its toothed wheel 64 drives toothed wheels 66 and 68 on vertical shafts 70 and 72 respectively which drive wheels 74 and 75 which in turn drive toothed wheel 76 on tubular member 78 which is mounted in housing 81 by bearings 80. Tubular member 78 is connected to, and drives, the drill bit 82. In this mode of operation the motor 54 works in its conventional way and the differential gearing 56 works as a reduction gearing to reduce the speed of rotation. Low speed rotation at high torque is particularly desirable when drilling with a large diameter rock bit e.g. 26" or more.

In another mode of operation the drill string can be rotated from the surface and the drilling fluids and cuttings can be pumped up the drill string using the motor 54 as a pump having positive displacement characteristics, employing reverse circulation. As previously described with reference to FIG. 1 by operating a valve (not shown) in the drill string above the water surface the flow of fluids moving upwardly through the drill string can be varied and the speed of revolution of the bit can thus be controlled by a combination of drill string speed and the degree of throttling of the valve. Sieve 79 attached to and rotating with tubular member 78 prevents entry of large particles of rock into the georotor.

I claim:

1. A method of drilling a hole in a formation which method comprises employing a drill bit connected to a drill string and rotating the drill bit by means of the drill string to drill the hole and form an annulus between the drill string and the wall of the hole and wherein a drilling fluid is circulated down the annulus and up through the drill string herein referred to a reverse circulation, and wherein there is located in the drill string above the drill bit a mechanical pump for upwardly moving the drilling fluid to reduce the hydrostatic pressure exerted by the drilling fluid on the formation being drilled, the drill bit and pump being operatively connected to a differential gearing located therebetween, the differential gearing being driven by the rotation of the drill string, and controllably varying the flow of drilling fluid flowing upwardly in the drill string and thereby controlling the torque applied to the pump and bit.

2. A method of drilling a hole in a formation as claimed in claim 1 which method comprises spudding in at an underwater location by contacting the formation with the drill bit and rotating the drill string to drive the pump and then reducing the flow of drilling fluid flowing upwardly in the drill string to increase the torque applied to the drill bit.

3. A method of drilling a hole in a formation which method comprises employing an apparatus comprising:

(a) a drill bit;

(b) a drill string connected to the drill bit;

(c) a motor connected to the drill string above the drill bit, the motor being rotatable by fluid pressure supplied from the surface and able to pump fluid to the surface by rotating the motor by means of the drill string;

(d) a differential gearing located between the motor and drill bit and operatively connected thereto, the differential gearing being capable of reducing the speed of rotation of the drill bit relative to the motor;

(e) a controllable valve arranged to controllably vary the flow of fluid in the drill string the arrangement being such that by controlling the flow of fluids in the drill string the torque applied to the bit and motor can be controlled and rotating the drill bit by means of the drill string to cause the motor to rotate and act as a pump to pump drilling fluid upwardly through the drill string to the surface.

* * * * *